US007019680B2

(12) United States Patent
Jackson et al.

(10) Patent No.: US 7,019,680 B2
(45) Date of Patent: Mar. 28, 2006

(54) HAND-HELD, CONTINUOUSLY VARIABLE, REMOTE CONTROLLER

(76) Inventors: Gregory P. Jackson, P.O. Box 712, San Marcos, CA (US) 92079; Arthur C. McBride, 705 Boganich Cir., Vista, CA (US) 92029; John L. Schooley, 1200 Loma Vista Way, Vista, CA (US) 92084

( * ) Notice: Subject to any disclaimer, the term of this patent is extended or adjusted under 35 U.S.C. 154(b) by 469 days.

(21) Appl. No.: 10/423,741

(22) Filed: Apr. 25, 2003

(65) Prior Publication Data

US 2004/0212528 A1 Oct. 28, 2004

(51) Int. Cl.
*G08C 19/00* (2006.01)
*G08C 19/12* (2006.01)

(52) U.S. Cl. ..... 341/176; 200/5 R; 200/331; 340/825.69

(58) Field of Classification Search ..... 341/176; 340/825.69
See application file for complete search history.

(56) References Cited

U.S. PATENT DOCUMENTS

| | | | | |
|---|---|---|---|---|
| 653,172 | A | 7/1900 | Coleman | |
| 1,204,675 | A | 11/1916 | Lyon | |
| 1,945,545 | A | 2/1934 | Finch | |
| 1,975,220 | A | 10/1934 | Ananiew | |
| 2,594,915 | A | 4/1952 | Guillemant | |
| 2,776,941 | A | 1/1957 | Lebowitz | |
| 3,193,629 | A | 7/1965 | Losch | |
| 3,401,354 | A | 9/1968 | Seidel | |
| 3,421,106 | A | 1/1969 | Garber | |
| 4,212,000 | A | 7/1980 | Yamada | |
| 4,344,046 | A | 8/1982 | Zumsteg | |
| 4,415,870 | A | 11/1983 | Zumsteg | |
| 4,575,688 | A | 3/1986 | Whitefoot | |
| 4,883,932 | A * | 11/1989 | Van Hout et al. | 200/339 |
| 5,023,417 | A * | 6/1991 | Magiera | 200/331 |
| 5,473,126 | A | 12/1995 | Wu | |
| 5,508,479 | A * | 4/1996 | Schooley | 200/5 R |
| 5,555,973 | A | 9/1996 | Horisawa | |
| 6,429,792 | B1 | 8/2002 | Burton | |

* cited by examiner

*Primary Examiner*—Michael Horabik
*Assistant Examiner*—Sisay Yacob
(74) *Attorney, Agent, or Firm*—John J. Murphey

(57) ABSTRACT

A continuously variable, remote controller including a pair of first and second frequency oscillating circuits, each circuit including a separate induction coil for producing an induction field thereabout, the normal resonating frequency of the first oscillating circuit being different from the normal resonating frequency of the second oscillating circuit, the first and the second oscillating circuits producing a baseline frequency that is the difference between the two the oscillating circuits, each of the induction coils including an induction field modifying armature, when a rocker block is pivoted about a fulcrum, in a first radial direction, the first induction field modifier engagement surface will engage the first induction field modifying armature and move it across the induction field generated by the first induction coil, to alter the oscillating frequency of the first frequency oscillating circuit, a subtractor adapted to receive the frequencies outputted from the first and the second frequency oscillating circuits and subtracting the lower of the frequencies from the higher of the frequencies to produce the difference between the frequencies, a microprocessor arranged to receive the difference between the frequencies, and a circuit board attached to the base plate, the frequency oscillating circuits being physically and electrically attached to the printed circuit board and electrically connected to the transmitting circuit.

23 Claims, 6 Drawing Sheets

HAND-HELD, CONTINUOUSLY VARIABLE, REMOTE CONTROLLER

BACKGROUND OF THE INVENTION

This invention pertains to devices for remotely controlling the movement of large, industrial equipment such as cranes, welders, rock crushers, and the like. These devices are called "controllers". More particularly, this invention pertains to controllers for causing changes in rates of movement in equipment through digital command pressure applied to control switches called "rocker blocks".

DESCRIPTION OF THE PRIOR ART

It is often desirable to control the movement of large equipment and yet remain outside that equipment. Equipment such as cranes, paving machines, welders, rock crushers, and the like are often better controlled by remaining outside the unit and directing it remotely. Especially with large equipment, the view from the cabin, wherein the operator usually resides, is often shielded, because of the massive size of the unit, from a close view of the surrounding area so that a crane may not pick up its load in a balanced manner, a paving machine may lay hot pavement outside appropriate boundaries, and welding equipment may direct the molten weld metal to areas not programmed for such a process.

Remote control is achieved either through a remote controller linked to the equipment by a cable, by a controller mounted on a control panel, or by a hand-held controller. While all these have been successful, they have been centered around push-pull switches, sliders, and toggle switches. These types of devices are sensitive to environmental conditions and, in the case of cable-attached and hand-held devices, are subject to rough handling. Often they are used in dusty or very humid environments, dropped or stepped on, all of which are potentially damaging to the interior components and to the accuracy of control of the equipment.

In addition, the hardiest of these controllers use push-pull, toggle and slide switches which provide control over the equipment in either incremental steps or stages or under a constant, albeit slow, velocity, each of which has disadvantages. Slow or incremental steps of movement, initiated by a controller, results in lost time when the movement is over a long period. Most controllers do not have the property of speeding up or slowing down the movement of controlled equipment other than by multiple pressing of buttons on the controller. When accelerated movement occurs, it is difficult to slow down or stop, i.e. without numerous pressing of buttons on the controller.

What is lacking in the industry is a rugged controller that can speed up the movement of equipment by simply pressing harder on a button or pressing a button deeper into the control panel. This same property should be able to slowdown equipment by releasing pressure on the button. Such a property would allow the operator to move equipment to a work site rapidly, undertake and perform the work quickly, and then remove the equipment from the work site rapidly so that the next operation could take place. Not only would this speed up construction but it would reduce down time of the equipment and result in more economical operations.

SUMMARY OF THE INVENTION

This invention is a continuously variable, remote controller enclosed in a housing and including a microprocessor to convert digital pressure on buttons to control signals that are transmittable either by radio signals through the air or electrical signals through wires and cables, to the equipment to be controlled. The controller includes a housing that uses a base member with a thin elastomeric web encircling and joining a rocker block where the rocker block has an upper surface, for pressing by a finger in one of two radial directions, and a lower surface. A pair of independent first and second frequency oscillating circuits are provided in the controller, where each circuit includes a separate induction coil, for producing an induction field thereabout, the normal resonating frequency of the first oscillating circuit being different from the normal resonating frequency of the second oscillating circuit, where the first and second oscillating circuits are connected together, in parallel, to produce a baseline frequency that is the difference between the two oscillating circuits.

Each induction coil includes its own induction field modifying armature positioned such that, when a rocker block, contacting each of the armatures, is pivoted about a fulcrum in a first radial direction, the first induction field modifying armature is moved, by finger pressure or digital command, across the induction field generated by the first induction coil to alter the oscillating frequency of the first frequency oscillating circuit. Likewise, when the rocker block is pivoted about the fulcrum in the opposite direction, the second induction field modifying armature is moved, by the same finger pressure or digital command, across the induction field generated by the second induction coil to alter the oscillating frequency of the second frequency oscillating circuit. A subtractor is provided and adapted to receive the frequencies outputted from the first and second frequency oscillating circuits and subtracts the lower of the frequencies from the higher of the frequencies to produce the difference between the frequencies. A microprocessor is also arranged to receive this difference between the frequencies. A circuit board, including the subtractor and the microprocessor, is attached to the housing where the frequency oscillating circuits are physically and electrically attached to the circuit board. The outputted signal from the microprocessor is proportional to the difference in one frequency oscillating circuit over the other circuit and becomes larger or smaller as more or less finger pressure is applied to the pivotal rocker. By using the difference of two oscillating circuits, the invention provides first order cancellation of frequency drift in the oscillator circuits, improved linearity by the armature, and rejection of common mode displacement of the armature caused by displacing the armature across both inductors simultaneously. The circuit output is a frequency range designed for direct input to the microprocessor.

One object of this invention is that the output of the invention is a frequency, which can be counted directly by a microprocessor and eliminates the need for an analog-to-digital converter, thus reducing power consumption and the need for a precision voltage reference. In addition, by using a microprocessor to output electromagnetic control signals, the controller can be attached by an umbilical cord to the equipment to be controlled or installed in a control panel that is connected to or made a part of the equipment. Further, the inductor and armature design permits a low profile, power efficient controller for use in small and portable cases. Finally, the balance circuit provides a highly stable output by first order cancellation of frequency drift in the oscillator circuits, improved linearity of the armature, and rejection of common mode displacement of the armature.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE PREFERRED EMBODIMENTS

Turning now to the drawings wherein elements are identified by numbers and like elements are identified by like numbers throughout the 8 figures, the preferred embodiment of the invention is depicted in FIGS. 1–4 and shows an elongated, continuously variable, remote controller 1, of a size and shape adapted to be held in one's hand, or mounted to an equipment control panel, including an outer housing 3, preferably made of rigid, light-weight molded plastic or stamped metal. Housing 3 contains a radio frequency electronic circuit 5 (FIG. 2) and a power source (not shown), for transmitting radio signals through an antenna, preferably an internal antenna, (also not shown) to a remote location, such as to a receiver located on or in a heavy piece of road equipment (not shown), where the radio signals actuate certain controls in and on the equipment to control the movements thereof. In place of an antenna, circuit 5 may also transmit signals through a cable (not shown) extending between controller 1 and the equipment to be controlled or to be mounted on a panel, either stationary or on the equipment to be controlled.

Figure 3:
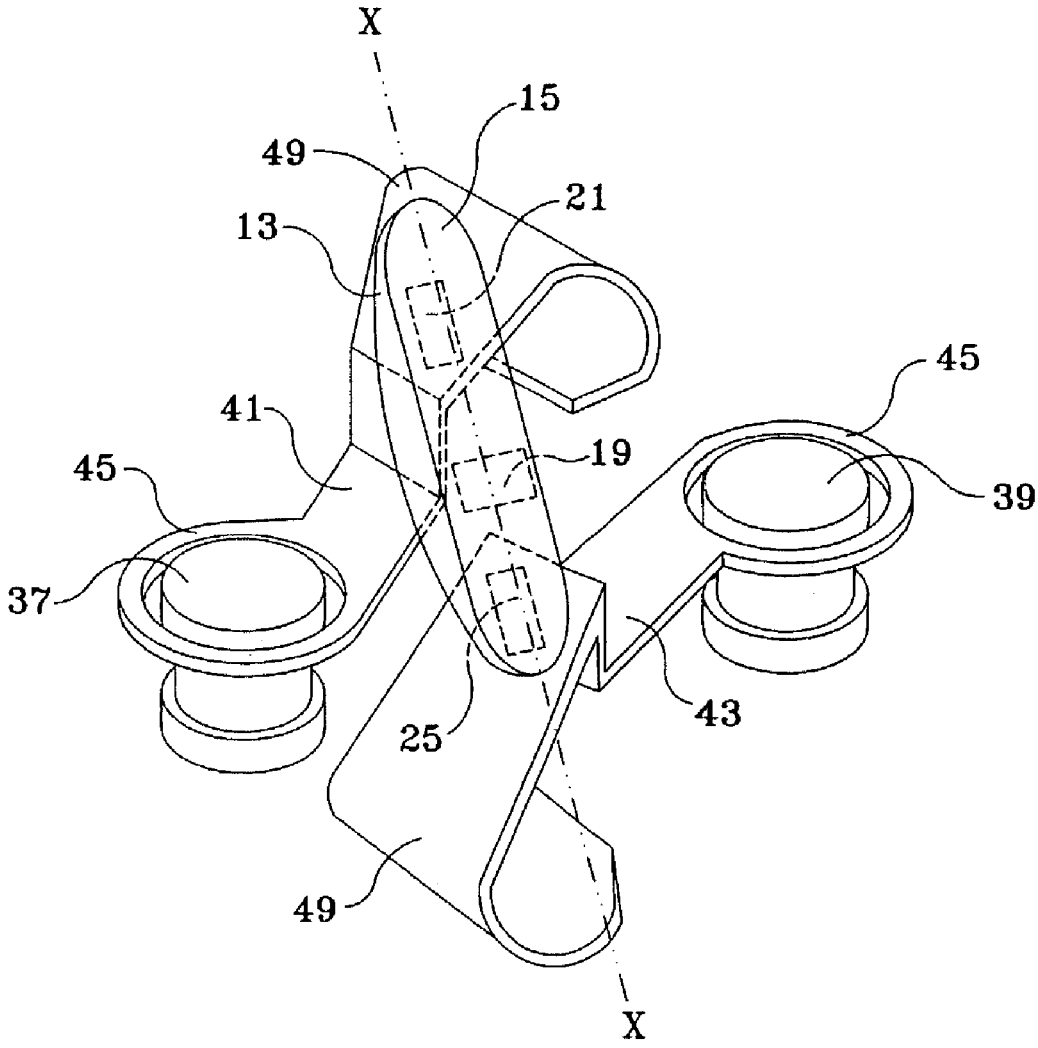
FIG. 3 is a perspective view of the preferred embodiment of the invention showing a rocker block spanning two, independent induction coil/modifying armature combinations.
Figure 4:
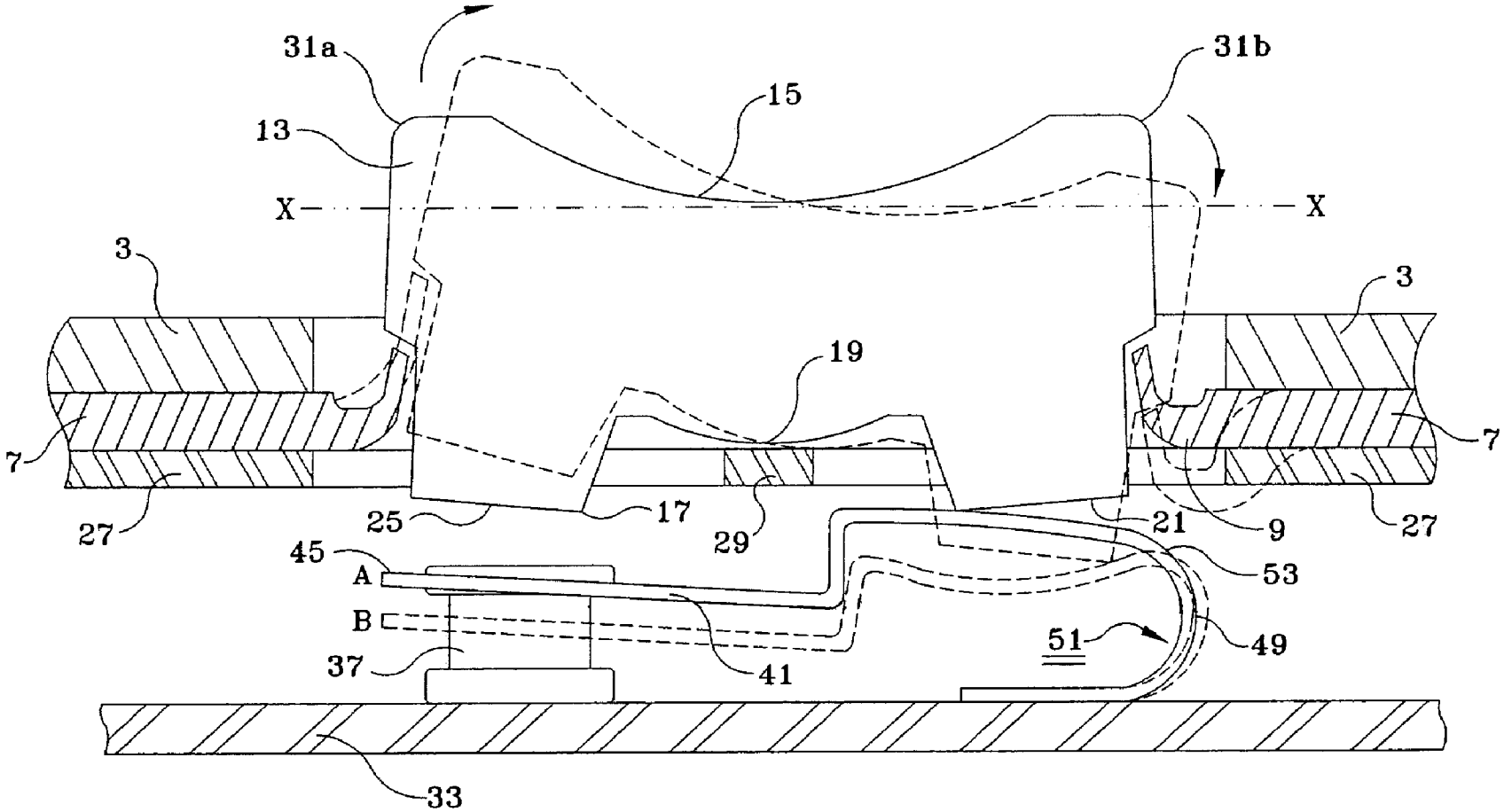
FIG. 4 is a side view, partially in section, of a typical rocker block and, in dotted line, its movement to move the armature over a single induction coil.

Also located within housing 3 is a base member 7 having formed therein a thin elastomeric web 9 that encircles and joins to at least one rocker block 13 as shown. As shown in FIGS. 3 and 4, rocker block 13 has formed externally thereon an upper surface 15 and a lower surface 17 that are preferably elongated along a longitudinal axis X—X that is parallel to said rocker block upper surface 15. Further, it is preferred that upper surface 15 of rocker block 13 be formed concave with respect to longitudinal axis X—X as shown in FIG. 4. Lower surface 17 includes a fulcrum 19 and spaced-apart first and second induction field modifier engagement surfaces 21 and 25. Rocker block lower surface 17 is preferably configured with a convex surface to facilitate pivoting rocker block 13 about fulcrum 19. A base plate 27 is provided, which includes a fulcrum bar 29 having openings therein for the downward passage of first and second induction field modifier engagement surfaces 25 and 27. Rocker bar lower surface 17 is further preferably configured to prevent interference of first and second induction field modifier engagement surfaces 21 and 25 with fulcrum bar 29 and wherein fulcrum 19 has a convex surface to facilitate pivoting rocker block 13 about fulcrum bar 29. It is further preferred that first and second induction field modifier engagement surfaces 21 and 25 extend in spaced-apart arrangement from lower surface 17 terminating at points below fulcrum 19.

Figure 2:
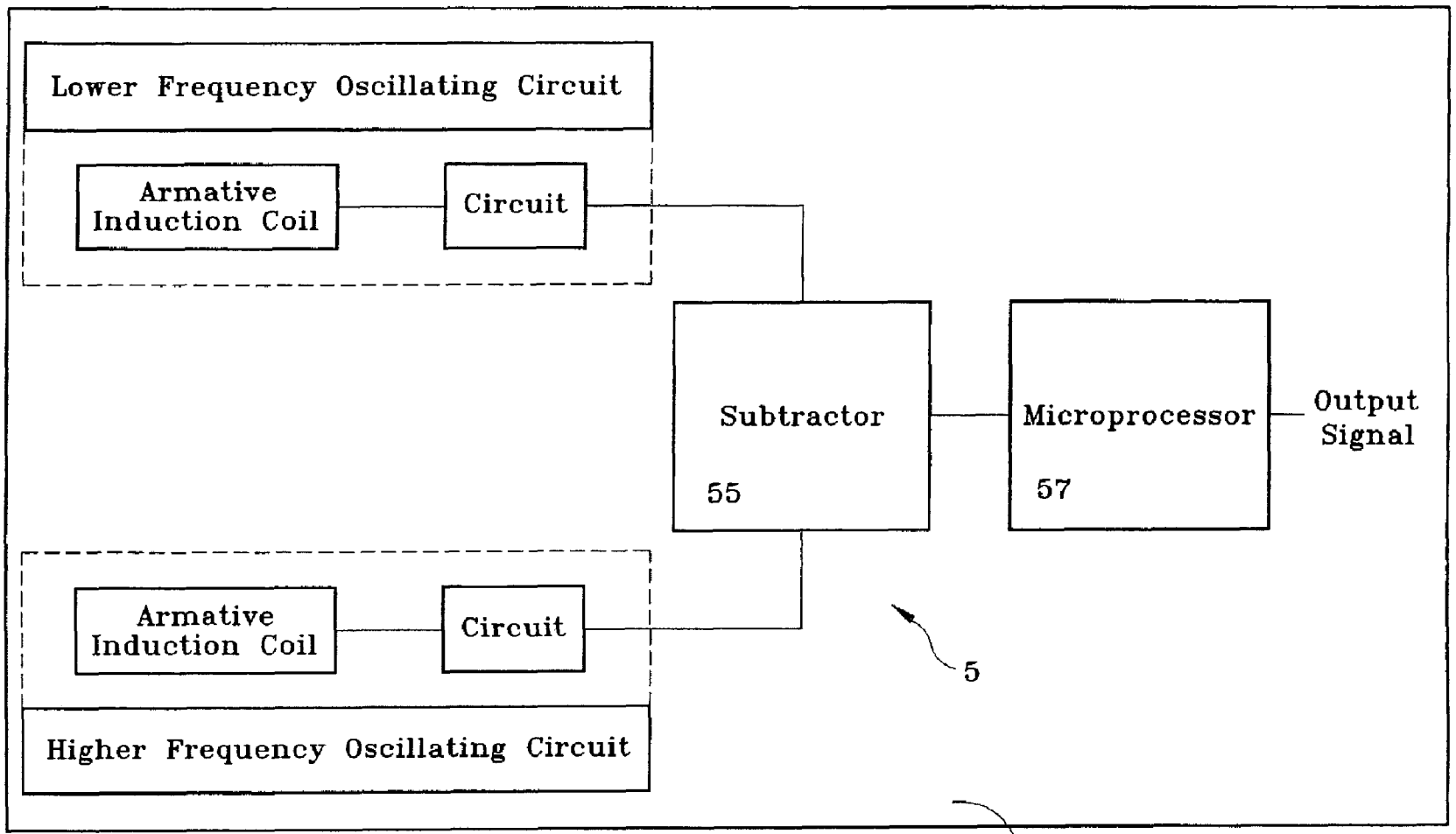
FIG. 2 is a plan view of some of the components, indicated in block diagram form, located on the circuit board.

A relatively flat, circuit board 33 is provided, spaced below base plate 27, and is shown in FIG. 2 to support the electrical components of this invention. When rocker block upper surface 15 is concave, as aforesaid, a pair of spaced-apart depressing areas, 31*a* and 31*b*, are formed on rocker block upper surface 15 for receipt of downward digital or finger pressure to wobble or rock rocker block 13, about fulcrum bar 29, in one radial direction, (shown in dotted outline and indicated by the arrows in FIG. 4) to lower or depress first induction field modifier engagement surface 21 and then wobble or rock it in the opposite radial direction, to separately lower second induction field modifier engagement surface 25. In this wobble action, rocker block upper surface 15 takes on the movement of a teeter totter and is moved by downward finger pressure, usually of the hand that holds controller 1. When controller 1 is panel-mounted, the downward finger pressure is usually from the hand nearest the controller. This action is described in this specification as "command digital pressure" because it is downward pressure on one of two separate areas of rocker block 13 that is purposely undertaken by the operator in the use of controller 1 to vary the speed at which a specific operation is being conducted by the equipment controlled by controller 1.

Figure 1:
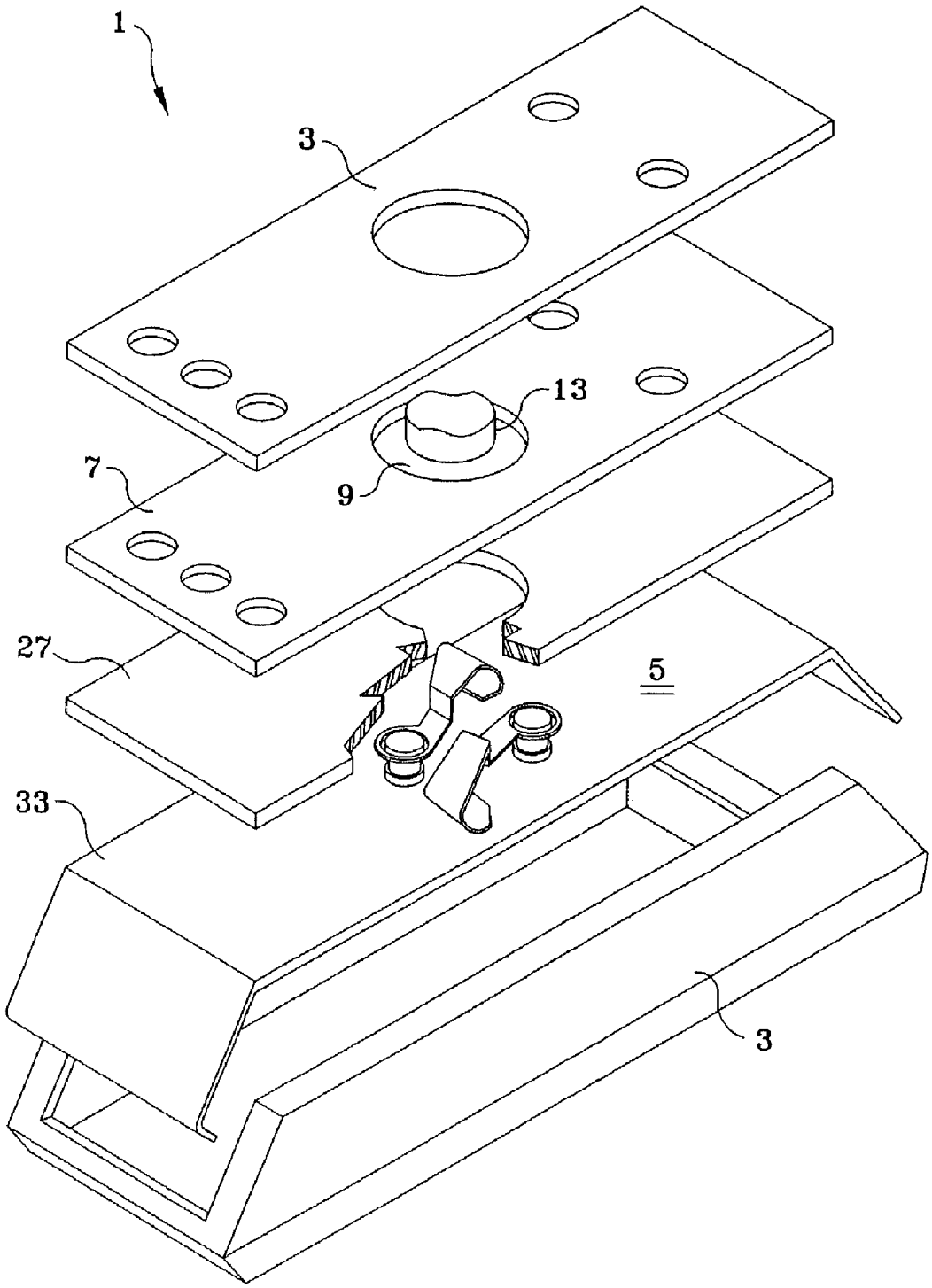
FIG. 1 is an assembly view of the main components of the preferred embodiment of the invention.

At least two (i.e., first and second) frequency oscillating circuits are formed on a flat, circuit board 33, along with a source of alternating electric power (not shown), where board 33 is assembled, along with base plate 27 and base member 7 in housing 3. As shown in FIGS. 1 and 3, and partially shown in FIG. 4, said first and second circuits each include a separate induction coil, 37 and 39, respectively, for producing, when energized by the alternating electric power source, an induction field about each coil. The normal resonating frequency of each of first and second oscillating circuits is purposely set at a different value so that their output produces a baseline frequency that represents the difference between the two oscillating frequency outputs. Induction coils, 37 and 39, each include an induction field modifying armature, 41 and 43, respectively.

First and second induction coils, 37 and 39, and first and second induction field modifying armatures, 41 and 43, are mounted in spaced-apart relationship so that their respective induction fields do not interfere with each other. First and second field modifying armatures 41 and 43 each include a first electrically conductive armature member 45 that encircles at least a part of its companion induction coil and is adapted to move, or be depressed, from a first or rest position A, located substantially at one end of its companion induction coil, to a second position B, located somewhere along the coil as determined by command digital pressure applied to rocker block 13, down through pressure area 31*b* and second induction field modifier engagement surface 25, onto a second armature member 49 that connects first armature member 45 to circuit board 33 or some other rigid anchor. It is preferred that first armature member 45 encircle its companion induction coil and it is further preferred that member 45 be formed as an electrically-conductive, closed, circular loop concentrically located about the coil as shown in FIGS. 1 and 3.

Also as shown in FIGS. 3 and 4, second armature member 49 has a bias function that maintains first armature 45 member in position A when command digital pressure is released from rocker block 13. Second armature member 49 preferably includes a bias means 51 such as a C-shaped spring 53 wherein member 49 and spring 53 are formed as a single unit, with one end of spring 53 attached to circuit board 33, or other solid surface, and the other end supporting member 45 in its concentric position about induction coil 37.

In this respect, first and second induction coils 37 and 39 are preferably mounted upright, with their respective elongated axes orthogonal to the plane of circuit board 33 (see FIGS. 3 and 4), and have circular cross-sections, as shown in FIGS. 1 and 3. Coils 37 and 39 are made short and cylindrical with numerous winds of fine electric wire wound tightly thereabout. This arrangement allows first and second induction field modifier engagement surfaces 21 and 25 to move downward against induction field modifying armatures 41 and 43, when rocker block upper surface areas 31*a* and 31*b* are alternately pressed, to press downward against first and second first armatures members 45 and cause second armature members to be depressed downward over coils 37 and 39 to effect the change in circuit oscillation frequency. This arrangement also provides the low profile to all the components that make up controller 1 and allows it to be easily carried in one's hand, during use, or slipped into one's pocket when not in use. Other coil cross-sections may be employed, such as triangular, rectangular, pentagonal and hexagonal, however, there appears no reason to depart from a cylindrical coil. It is important, in making controller 1, to have all the components arranged in a low profile so that the fully assembled controller remains small and tightly compacted in order to be easily held in one's hand or mounted on a crowded control panel.

In operation, command digital pressure against area 31*a* or 31*b* on rocker block 13 moves first armature member 45 along and over its companion coil 37, and changes the output frequency in the frequency oscillation circuit. Because position A of member 45 is at one end of the coil, movement of the member along the coil raises the oscillation frequency in the circuit providing a greater or lesser difference between that frequency and the nominal frequency of the other circuit.

A subtractor 67 (see FIG. 2) is provided in controller 1, to receive the respective frequencies outputted from the first and second frequency oscillating circuits, to subtract the lower of said frequencies from the higher of said frequencies to produce the difference between them. This difference in frequencies is then outputted to a microprocessor 57, also provided inside controller 1, that counts the inputted frequency and converts it into a coded output that is transmitted by the antenna or by cable to the equipment.

Circuit board 33 preferably contains printed circuits, for ruggedness of design, and subtractor 55 and microprocessor 57 are physically and electrically attached in spaced relationship to board 33 and electrically connected to transmitting circuit 5.

Figure 5:
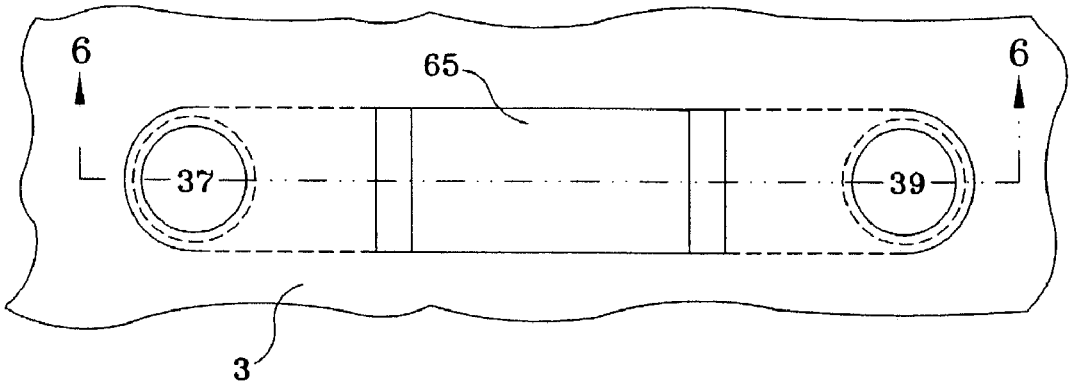
FIG. 5 is a top plan view showing another embodiment of the invention.
Figure 6:
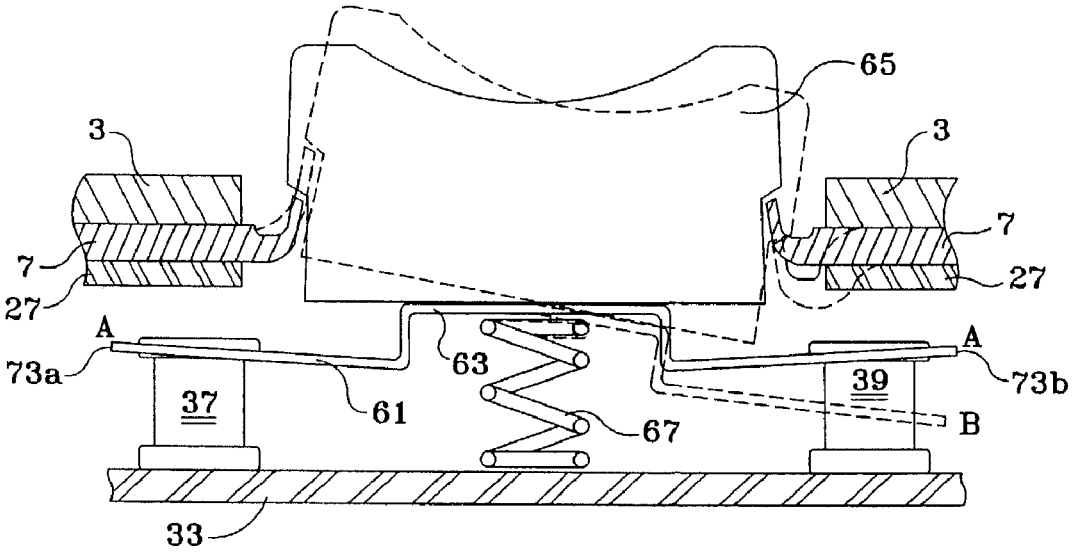
FIG. 6 is a side view, partially in section, taken along lines 6—6 of the embodiment shown in FIG. 5.

In another embodiment of the invention, shown in FIGS. 5 and 6, rocker block 13 is replaced by a free-floating first armature member 61 having a center section 63, covered by a pivot block 65. Member 61 is supported in a level posture by a centralized coil spring 67 and moveable by command digital pressure applied to a pivot block 65. Second armature members, preferably in the form of conductive loops 73*a* and 73*b*, are formed in spaced-apart arrangement, one at each end of arm 61, each loop located in concentric sliding assembly over first and second, spaced-apart, induction coils 37 and 39. The neutral positions of each loop 73*a* and 73*b* are in a first position A, located substantially to one end of their companion induction coils. By command digital pressure on pivot block 65, arm 61 is made to move downward and pivot about spring 67 either to move loop 73*a* downward, along its companion coil, to a second position B, located somewhere along the coil, to alter the oscillating frequency of this circuit, or move loop 73*b* downward, along its companion coil, to a second position B, located somewhere along the coil, to alter the oscillating frequency of that circuit. In the alternative, both loops 73*a* and 73*b* may be moved by command digital pressure and the internal circuitry of controller 1 will compute the difference between them. As earlier stated, while second armature members or loops 73*a* and 73*b* are located about their companion coils, it is preferred that they completely encircle their respective companion induction coil. The use of this type of proportional controller provides first order cancellation of frequency drift in the oscillator circuits, improved linearity by the armature, and rejection of common mode displacement of the armature caused by displacing the armature across both inductors simultaneously. The circuit output is a frequency range designed for direct input to microprocessor 57.

Figure 7:
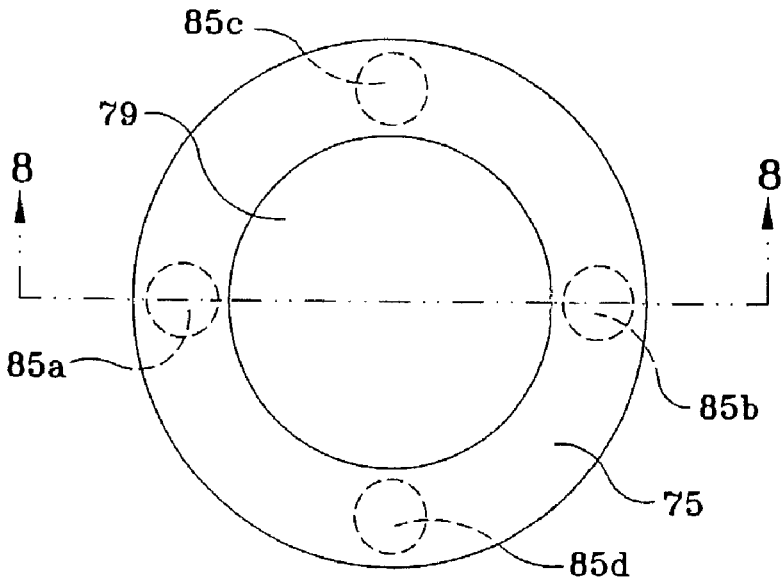
FIG. 7 is a partial top plan view of still another embodiment of the invention; and, FIG. 8 is a side view, taken along lines 8—8, of the embodiment shown in FIG. 7.
Figure 8:
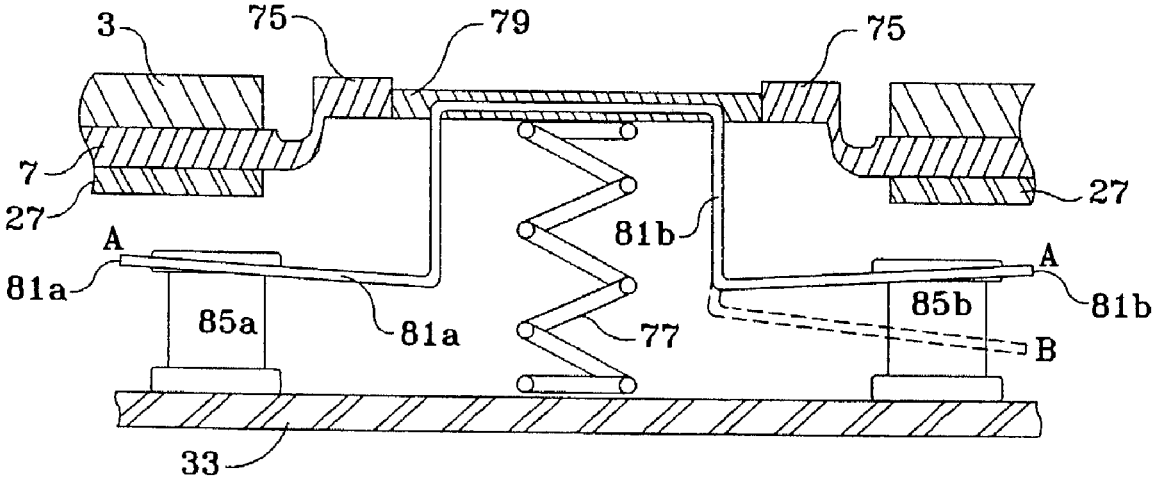

In still another embodiment of the invention, shown in FIGS. 7 and 8, rocker block 13 is replaced by a free-floating circular armature 75, supported in a level or horizontal, neutral position by at least one, centralized, coil spring 77 and covered by a center plate 79 where armature 75 is adapted to receive command digital pressure from an operator. A plurality, such as four, armature members, or loops 81*a*–81*d* (only two of which are shown) are formed, one under each quadrant of armature 79, in spaced-apart arrangement, each loop located in concentric sliding assembly over one of four spaced-apart induction coils 85*a* through 85*d* (only two are shown). The neutral positions of each loop 81*a*–81*d* are in a first position A, located substantially to one end of their companion induction coils. Command digital pressure applied to pressure points on circular armature 75 causes it to pivot about spring 77 to move any of loops 81*a*, 81*b*, 81*c*, 81*d*, or a combination of them, downward, along their companion coils, to a second position B, located somewhere along the coil, to alter the oscillating frequency of that particular circuit. As earlier stated, it is preferred that loops 81*a* through 81*d* completely encircle their respective companion induction coils.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A controller comprising:

a) a housing (3);

b) an electronic transmitting circuit (5) mounted within said housing;

c) a base member (7) having formed therein a thin elastomeric web (9), said web encircling and joined to a rocker block (13), said rocker block having upper (15) and lower (17) surfaces wherein the lower surface (17) includes a fulcrum (19) and first and second induction field modifier engagement surfaces (21, 25);

d) a base plate (27) including a fulcrum bar (29), said fulcrum bar being configured to pivotally engage said fulcrum (19) of said rocker block (13), said base plate (27) being attached within said housing (3);

e) a pair of first and second frequency oscillating circuits, each said circuit including a separate induction coil (37, 39), for producing an induction field thereabout, the normal resonating frequency of said first oscillating circuit being different from the normal resonating frequency of said second oscillating circuit, said first and said second oscillating circuits producing a baseline frequency that is the frequency difference between the two said oscillating circuits, each said induction coil (37, 39) including an induction field modifying armature (41, 43);

f) said first and second induction coils (37, 39) and said induction field modifying armatures (41, 43) being held in spaced relationship and proximate to first and second induction field modifying armature engagement surfaces (21, 25), each said induction coil (37, 39) positioned such that, when said rocker block (13) is pivoted about said fulcrum bar (29), in a first radial direction, said first induction field modifier engagement surface (21) will engage said first induction field modifying armature (41) and move it across said induction field generated by said first induction coil (37), to alter the oscillating frequency of said first frequency oscillating circuit, and when said rocker block (13) is pivoted about said fulcrum bar (29) in the opposite direction, said second induction field modifier engagement surface (25) will engage said second induction field modifying armature (43) and move it across said induction field generated by said second induction coil (39) to alter the oscillating frequency of said second frequency oscillating circuit;

g) a subtractor (55) adapted to receive said frequencies outputted from said first and said second frequency oscillating circuits and subtracting the lower of said frequencies from the higher of said frequencies to produce the frequency difference between the frequencies;

h) a microprocessor (57) arranged to receive the frequency difference between the frequencies; and, i) a circuit board (33), including said subtractor (7) and said microprocessor (57), being attached in spaced relationship to said base plate (27), said frequency oscillating circuits being physically and electrically attached to said circuit board (33) and electrically connected to said transmitting circuit (5).

2. The controller of claim 1 wherein said rocker block (13) is elongated along a longitudinal axis (X—X) parallel to said rocker block upper surface (15).

3. The controller of claim 1 wherein said upper surface (15) of said rocker block (13) is concave.

4. The controller of claim 1 wherein said rocker block (13) further includes first and second induction field modifier engagement surfaces (21, 25) extending in spaced-apart arrangement from said lower surface (17) terminating at points below said fulcrum (19).

5. The controller of claim 1 wherein each said first and second induction field modifying armatures (41, 43) includes a first member (45), adapted to at least partially encircle said companion induction coils (37, 39).

6. The controller of claim 1 wherein said first and second induction field modifying armatures (41, 43) each include a closed, conductive loop arranged fully to encircle its companion induction coil (37, 39), and is adapted to move from a first, rest position (A), located substantially at one end of its companion induction coil, to a second position (B), located somewhere along said coil, as determined by command digital pressure applied to said rocker block (13) and further including a bias means (51) to return said conductive loop to said first position (A) following release of said command digital pressure.

7. The controller of claim 1 wherein said first induction coil (37) is arranged vertically and said first induction field modifier engagement surface (21) is adapted to contact and depress said first induction field modifying armature (41) and, when said first induction field modifying armature (41) is depressed, likewise depresses said first armature member (45) downward along the length of said first induction coil (37) to change the inductance in said coil and the frequency in said frequency oscillation circuit.

8. The controller of claim 1 wherein said rocker block (13) has a lower surface (17) configured to prevent interference of said first and second induction field modifier engagement surfaces (21, 25) with said fulcrum bar (29) and wherein the fulcrum (19) of said rocker block (13) has a convex surface to facilitate pivoting of said rocker block (13) about said fulcrum (19) and said fulcrum bar (29).

9. The controller of claim 6 wherein said first armature member (45) includes a bias means (51).

10. The controller of claim 5 further including a bias means (51) wherein said first member (45) and said bias means (51) are formed as a single unit.

11. The controller of claim 1 wherein said first and second inductor coils (37, 39) each have a cylindrical cross-section.

12. The controller of claim 1 wherein said housing (3) is made small enough to hold in one's hand and said microprocessor (57) outputs a radio frequency to said transmitting circuit to provide a stream of transmitted radio control signals.

13. The controller of claim 1 wherein said housing (3) is made small enough to hold in one's hand and said microprocessor (57) outputs a frequency to said transmitting circuit to provide a stream of transmitted electrical control signals.

14. A continuously variable elongated, remote controller (1) of a size and shape adapted to be held in one's hand, comprising:

a) an elongated, outer housing (3), b) an electronic transmitting circuit (5) mounted within said housing;

c) a base member (7) having formed therein a thin elastomeric web (9), said web encircling and joined to a pivot block (65);

d) a first armature (61), including a center section (63), supported in a level posture by a centralized spring (67), and moveable by command digital pressure applied thereto through said pivot block;

e) a pair of first and second frequency oscillating circuits, each said circuit including first and second separate induction coils (37, 39), for producing an induction field about each said coil, the normal resonating frequency of said first oscillating circuit being different from the normal resonating frequency of said second oscillating circuit, said first and said second oscillating circuits producing a baseline frequency that represents the frequency difference between the frequency outputs of said two oscillating circuits;

f) a pair of first armature members (45), one said armature member located in spaced-apart arrangement at each end of said arm (61), each said first armature member located in concentric sliding assembly over said first and second, spaced-apart, induction coils (37, 39) where the neutral positions of each said armature members (45) are in a first position located substantially to one end of their companion induction coils, and moveable, by command digital pressure applied to said pivot block (65), downward, along its companion coil, to a second position, located somewhere along said companion coil, to alter the oscillating frequency of that circuit;

g) a subtractor (55) adapted to receive said frequencies outputted from said first and said second frequency oscillating circuits and subtracting the lower of said frequencies from the higher of said frequencies to produce the frequency difference between the frequencies; and, h) a microprocessor (57) arranged to receive the frequency difference between the frequencies and output either a control radio frequency or electromagnetic control signals in response thereto.

15. The remote controller of claim 14 wherein said rocker block (13) is elongated along a longitudinal axis (X—X) parallel to said rocker block upper surface (15).

16. The remote controller of claim 14 wherein said upper surface (15) of said rocker block (13) is concave.

17. The remote controller of claim 14 wherein said first armature members (45, 49) include loops adapted to encircle at least a portion of said companion induction coils (37, 39).

18. The remote controller of claim 14 wherein said first armature members (45, 49) include electronic-conductive, enclosed loops adapted to fully encircle said companion induction coils (37, 39).

19. The remote controller of claim 14 wherein said first induction field modifying armature (41) includes a centralized support coil spring (67) and said arm (61) includes first armature member including closed, conductive loops that encircle their respective companion induction coils.

20. The remote controller of claim 14 wherein said pivot block (65) is elongated along a longitudinal axis (X—X) parallel to said pivot block upper surface.

21. A hand-held, continuously variable, remote controller comprising:

a) a housing (3);

b) a radio frequency electronic transmitting circuit (5) mounted within said housing;

c) a flat base member (7) having formed therein a thin elastomeric web (9), said web encircling and joined to a first induction field modifying armature (41), including a circular armature (75), supported in a horizontal, neutral position by at least one, centralized, spring (77) and covered by a center plate (79) adapted to receive thereon command digital pressure from an operator;

d) a plurality of frequency oscillating circuits, each said circuit including separate induction coils (91*a*, 91*b*, 91*c*, 91*d*), for producing an induction field thereabout, the normal resonating frequency of each said oscillating circuit being different from the normal resonating frequency of said other oscillating circuits, said oscillating circuits producing a baseline frequency that represents the frequency difference between them;

f) a plurality of second armature members, one located in spaced-apart arrangement over each one of said separate induction coils (81*a*, 81*b*, 81*c*, 81*d*), each said second armature members located in concentric sliding assembly over their respective companion induction coils wherein the neutral positions of each second armature members are located substantially to one end of their companion induction coils, and moveable, by command digital pressure on said circular armature (75), downward, along its companion coil, to a second position, located somewhere along said companion coil, to alter the oscillating frequency of that circuit;

g) a subtractor (55) adapted to receive said frequencies outputted from said plurality of said oscillating circuits and subtracting the lower of said frequencies from the higher of said frequencies to produce the frequency difference between the frequencies;

h) a microprocessor (57) arranged to receive the difference between the frequencies and output a control frequency in response thereto; and, i) a circuit board (33), including said subtractor (55) and said microprocessor (57), being attached in spaced relationship to said base plate (27), said frequency oscillating circuits being physically and electrically attached to said circuit board (33) and electrically connected to said transmitting circuit (5).

22. The remote controller of claim 21 wherein said plurality of first induction field modifying armature members at least partially encircle said induction coils (81*a*, 81*b*, 81*c*, 81*d*), and are adapted to move from a first position, substantially outside the induction fields of said coils, to a second position along the lengths of said coils.

23. The remote controller of claim 21 wherein said plurality of first induction field modifying armature members are conductive, closed loops that fully encircle said induction coils (81*a*, 81*b*, 81*c*, 81*d*).

* * * * *